US005515657A

United States Patent [19]

Chou

[11] Patent Number: 5,515,657

[45] Date of Patent: May 14, 1996

[54] WINDING STAIR

[76] Inventor: Johnson Chou, No. 12, Lane 261, Fu Yuan St., Sung Shan Chu, Taipei, Taiwan

[21] Appl. No.: 515,157

[22] Filed: Aug. 15, 1995

[51] Int. Cl.[6] ..... E04F 11/032

[52] U.S. Cl. ..... 52/187; 52/184; 182/194

[58] Field of Search ..... 52/187, 182, 184, 52/185, 186; 182/100, 132, 189, 187, 194

[56] References Cited

U.S. PATENT DOCUMENTS

| | | | |
|---|---|---|---|
| 424,533 | 4/1890 | Belles | 52/187 |
| 485,449 | 11/1892 | Borneman et al. | 52/187 |
| 1,726,133 | 8/1929 | Wilson | 52/187 |
| 3,399,746 | 9/1968 | Wood | 52/189 |
| 3,740,906 | 6/1973 | Schneider | 52/187 |
| 4,190,992 | 3/1980 | Takenaga | 52/187 |
| 4,587,780 | 5/1986 | Rorke | 52/187 |
| 4,722,374 | 2/1988 | Bond | 52/187 |
| 4,791,764 | 12/1988 | Hicks | 52/187 |
| 4,850,164 | 7/1989 | McLeod | 52/187 |

FOREIGN PATENT DOCUMENTS

| | | | |
|---|---|---|---|
| 106694 | 3/1943 | Sweden | 52/187 |

*Primary Examiner*—Michael Safavi
*Attorney, Agent, or Firm*—Jacobson, Price, Holman & Stern

[57] ABSTRACT

A winding stair for spiral ascension within a building structure. The stair includes a newel post which has a plurality of elongated slots horizontally formed around the periphery at different elevations. Each steps of the winding stair is provided with an arched end plate located along an inner narrow end of the step. With each arched end plate formed to hug the outer surface of the newel post. A curved flange portion extends upwardly along a top edge of the arched end plate. Steps are attached to the newel post as by inserting the curved flange portion within the elongated slots and allowing the arched end plate to rest against the periphery of the newel post. Aligned openings in each of the newel post and arched end plate, receive fasteners to secure the step to the newel post. The curved flange also has openings aligned with openings in the newel post receiving fasteners which serves to further secure the step to the post. At least one baluster is inserted through at least one through hole located at an outer broader end of each step. With a hand rail being secured to an upper end of the balusters.

4 Claims, 3 Drawing Sheets

WINDING STAIR

BACKGROUND OF THE INVENTION

The present invention relates to a winding stair which comprises a newel post having elongated slots around the periphery at different elevations and screw holes corresponding to the elongated slots, a plurality of steps respectively hooked in the elongated slots and then fixedly secured to the screw holes by screws, and a plurality of balusters respectively fastened to respective through holes at the steps far from the newel post to support a step and a handrail, if any, above the steps.

Regular winding stairs are commonly comprised of a newel post, a plurality of flat, conical steps (about ten to twelve pieces) mounted around the newel post, a handrail, and a plurality of balusters connected between the steps and the handrail. Each step has a shorter end made with a mounting ring for coupling to the newel post, and a broader end made with two through holes for mounting a respective baluster. The balusters are respectively inserted through the through holes of the steps, each having a bottom end fixedly secured to the floor and a top end fixedly connected to the handrail. During the installation, the mounting rings of the steps are respectively sleeved onto the newel post, then respectively adjusted to the desired angles, and then fixedly secured at the desired angles. Because the steps are heavy (each step weights about 10 kgs), it is difficult to fixedly secure the steps at the desired angles. Furthermore, because the steps are fastened to the newel post by the respective mounting rings, they tend to vibrate or slip from place when they bear an excessive weight.

SUMMARY OF THE INVENTION

The present invention has been accomplished to provide a winding stair which eliminates the aforesaid drawbacks. According to one aspect of the present invention, the newel post has a plurality of elongated slots horizontally made around the periphery at different elevations, at least one first screw hole above each elongated slot, and at least one second screw hole below each elongated slot; the steps each has at least one through hole at one end, which holds a respective baluster, an arched end plate at an opposite end closely attached to the periphery of the newel post, a curved flange raised from the arched end plate and hooked in one elongated slot, at least one first coupling hole at the curved flange respectively connected to the at least one first screw hole above the corresponding elongated slot by a respective screw, and at least one second coupling hole at the arched end plate respectively connected to the at least one second screw hole below the corresponding elongated slot by a respective screw. Therefore, when the steps are respectively fastened to the elongates slots of the newel post, they are well installed and need not to be adjusted. Because the curved flanges of the steps are respectively hooked in the elongated slots of the newel post, the steps do not slip from place when they bears the weight.

DETAILED DESCRIPTION OF THE PREFERRED EMBODIMENT

Figure 1:
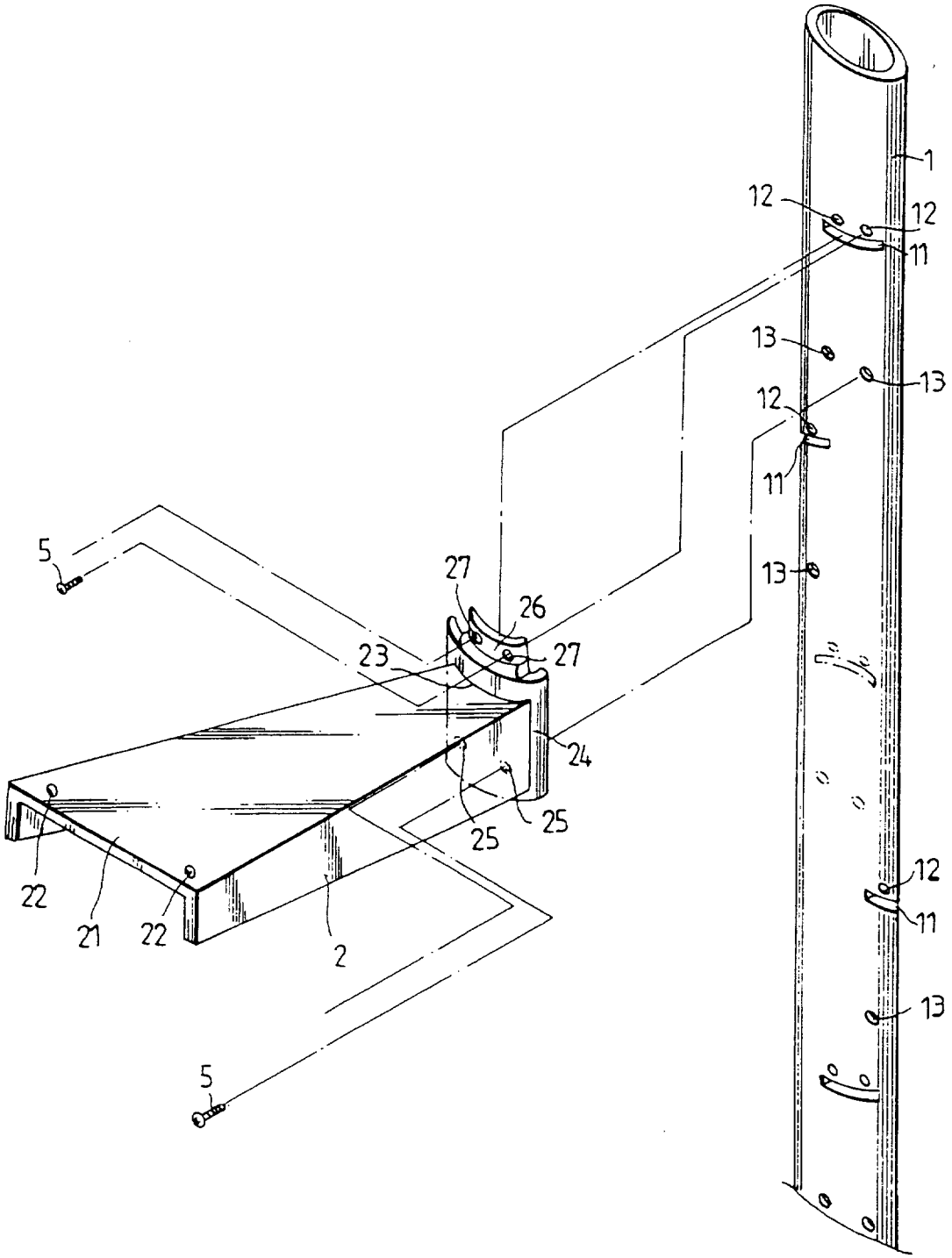
FIG. 1 is an exploded view of the winding stair according the present invention.

Referring to FIG. 1, a winding stair in accordance with the present invention comprises a newel post 1, a plurality of steps 2, a plurality of balusters 3, and a handrail 4.

Figure 2:
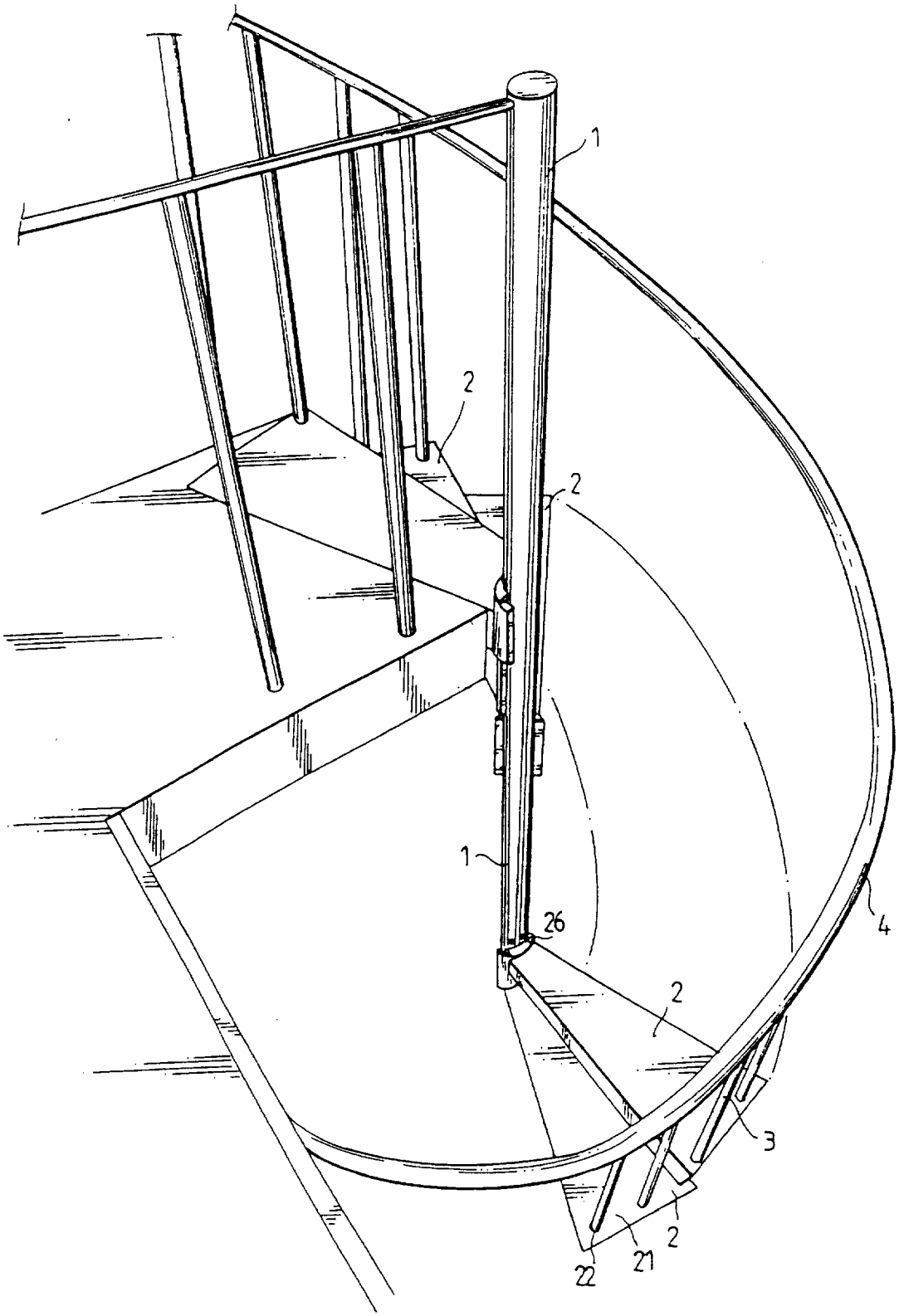
FIG. 2 is a perspective view showing the winding stair of preferred embodiment of the present invention installed

Referring to FIGS. 1, 2, in the preferred embodiment the newel post 1 is a hollow, round tube having a plurality of elongated slots 11 horizontally made around the periphery at different elevations for mounting a respective step 2, at least one first screw hole 12 above each elongated slot 11, and at least one second screw hole 13 below each elongated slot 11, wherein each two adjacent elongated slots 11 are not vertically aligned. Each step 2 comprises a broader end 21, at least one through hole 22 at the broader end 21 for mounting a baluster 3, a shorter end 23, an arched end plate 24 at the shorter end 23 of curvature fitting the periphery of the newel post 1, a curved flange 26 raised from the arched end plate 24 for insertion into one elongated slot 11, at least one first coupling hole 27 at the curved flange 26 corresponding to the at least one first screw hole 12 above each elongated slot and at least one second coupling hole 25 at the arched end plate 24 corresponding to the at least one second screw hole 13 below each elongated slot 11. Each baluster 3 has a bottom end fixedly secured to the floor and a top end inserted into one through hole 22 at the broader end 21 of one step 2 and then fixedly secured in place at the desired height for supporting the handrail 4. The handrail 4 is a smoothly curved bar fixedly secured to the top ends of the balusters 3. In another preferred embodiment as shown in FIG. 3, each baluster 3 has a bottom end fixedly secured to the floor, and a top end inserted into one through hole 22 at the broader end 21 of one step 2 and fixedly secured thereon, the baluster 3 is fixedly secured in place at the desired height for supporting the step 2

Figure 3:
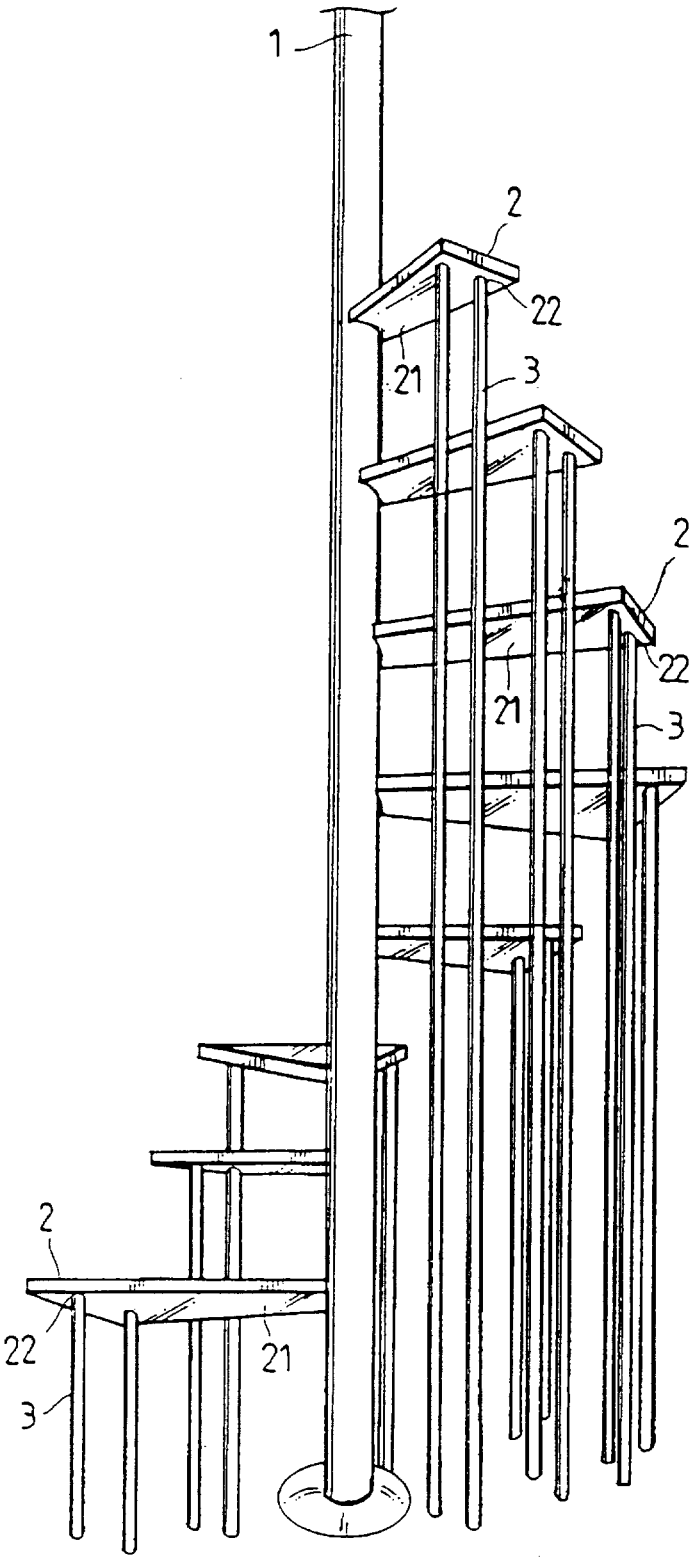
FIG. 3 is a perspective view showing the winding stair of another preferred embodiment of the present invention installed.

Referring to FIG. 3 and FIG. 1 again, the newel post 1 is fixedly secured to the floor at the desired location, then the curved flanges 26 of the arched end plates 24 of the steps 2 are respectively hooked in the elongated slots 11, permitting the arched end plates 24 of the steps 2 to be closely attached to the periphery of the newel post 1, then the first coupling holes 27 and the second coupling holes 25 of the steps 2 are respectively fastened to the first screw holes 12 and second screw holes 13 of the newel post by screws 5, then the balusters 3 are respectively inserted through the through holes 22 at the broader ends 21 of the steps 2 and fixedly secured in place at the desired height, and then the handrail 4 is fixedly secured to the top ends of the balusters 3 around the newel post 1.

It is to be understood that the drawings are designed for purposes of illustration only, and are not intended as a definition of the limits and scope of the invention disclosed.

I claim:

1. A winding stair comprising:

a newel post having a plurality of elongated slots horizontally made around the periphery at different elevations, each two adjacent elongated slots being not vertically aligned, at least one first screw hole above each elongated slot, and at least one second screw hole below each elongated slot;

a plurality of steps respectively mounted around said newel post at different elevations, each step comprising a broader first end, at least one through hole at said broader first end, a shorter second end, an arched end plate disposed at said shorter second end and closely attached to the periphery of said newel post, a curved flange raised from said arched end plate and inserted into one elongated slot, at least one first coupling hole at said curved flange respectively connected to the at least one first screw hole above the corresponding elongated slot by a respective screw, and at least one second coupling hole at said arched end plate respectively connected to the at least one second screw hole below the corresponding elongated slot by a respective screw; and a plurality of balusters respectively connected between a supporting plane and said steps, each baluster having a bottom end fixedly secured to said supporting plane and a top end fastened to one through hole at the broader end of one step.

2. The winding stair of claim 1 wherein each step is made from a U-frame shaped like a truncated cone having a broader first end, which holds said baluster, and a shorter second end, which is fastened to said newel post.

3. The winding stair of claim 1 wherein each baluster has a top end inserted through one through hole at the broader first end of one step to support a handrail above said steps.

4. The winding stair of claim 1 wherein the broader first end of each step has two through holes for mounting two balusters.

* * * * *